US007081047B2

(12) United States Patent
Palushaj

(10) Patent No.: US 7,081,047 B2
(45) Date of Patent: Jul. 25, 2006

(54) BRISTLE BRUSH FOR CONCRETE SANDING

(75) Inventor: Simon Palushaj, Shelby Township, MI (US)

(73) Assignee: Epoxi-Tech, Inc., Madison Heights, MI (US)

( * ) Notice: Subject to any disclaimer, the term of this patent is extended or adjusted under 35 U.S.C. 154(b) by 0 days.

(21) Appl. No.: 11/042,698

(22) Filed: Jan. 25, 2005

(65) Prior Publication Data

US 2005/0260941 A1 Nov. 24, 2005

Related U.S. Application Data

(63) Continuation of application No. 10/851,393, filed on May 21, 2004.

(51) Int. Cl.
*B24D 17/00* (2006.01)

(52) U.S. Cl. ..... 451/490; 451/359

(58) Field of Classification Search ..... 451/490, 451/466, 468, 359, 258, 260; 15/230
See application file for complete search history.

(56) References Cited

U.S. PATENT DOCUMENTS

| | | | | |
|---|---|---|---|---|
| 3,696,563 | A * | 10/1972 | Rands | 451/466 |
| 4,490,872 | A | 1/1985 | Drumm | |
| 4,493,126 | A | 1/1985 | Uy | |
| 4,507,361 | A | 3/1985 | Twilley et al. | |
| 4,561,214 | A * | 12/1985 | Inoue | 451/1 |
| 4,662,044 | A | 5/1987 | Kayabara | |
| 5,224,231 | A | 7/1993 | Nacar | |
| 5,323,505 | A | 6/1994 | Montabaur et al. | |
| 5,445,438 | A | 8/1995 | Drumm | |
| 5,491,025 | A * | 2/1996 | Pihl et al. | 428/373 |
| 5,679,067 | A * | 10/1997 | Johnson et al. | 451/527 |
| 5,983,434 | A * | 11/1999 | Eichinger et al. | 15/180 |
| 6,126,533 | A * | 10/2000 | Johnson et al. | 451/527 |
| 6,249,928 | B1 | 6/2001 | Wang | |
| 6,352,471 | B1 * | 3/2002 | Bange et al. | 451/527 |
| 6,422,932 | B1 * | 7/2002 | Lageson et al. | 451/466 |
| 6,665,902 | B1 | 12/2003 | Vegter | |
| 6,669,746 | B1 | 12/2003 | Niizaki et al. | |
| 2002/0094437 | A1 | 7/2002 | Niizaki et al. | |
| 2002/0148059 | A1 | 10/2002 | Lin | |
| 2002/0182983 | A1 | 12/2002 | Yamamoto et al. | |

FOREIGN PATENT DOCUMENTS

| | | |
|---|---|---|
| GB | 1 262 020 | 2/1972 |

* cited by examiner

*Primary Examiner*—Dung Van Nguyen
(74) *Attorney, Agent, or Firm*—Reising, Ethington, Barnes, Kisselle, P.C.

(57) ABSTRACT

A brush or pad (10) for a power sander for sanding surfaces includes a base (12) for mounting onto a power sander and a plurality of depending bristles (16) with the bristles having a plurality of hard particles (22), for example diamonds particles of grit 70 size, brazed or otherwise secured onto the bristle surface such that as the bristle wears down, new particle surfaces are exposed at the distal end (20) of the bristle to maintain sanding performance of the brush. The particles (22) may be spot brazed in steel with a brazing alloy to retain flexibility of the steel bristle.

5 Claims, 2 Drawing Sheets

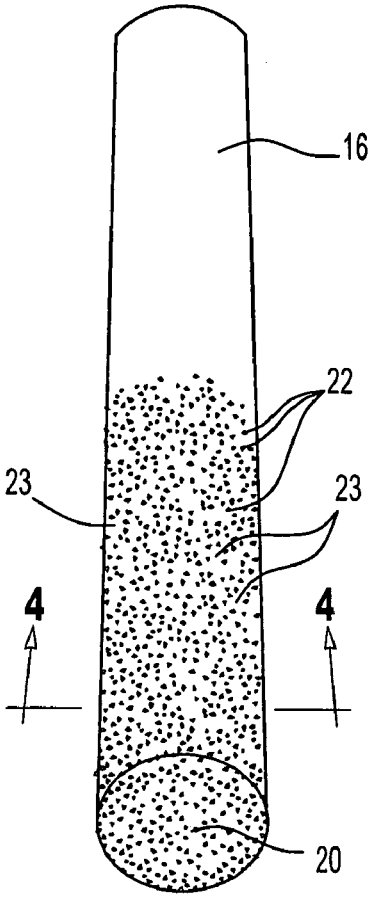
Fig-3
Fig-4
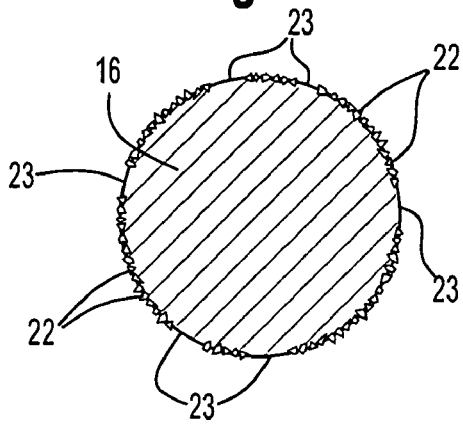
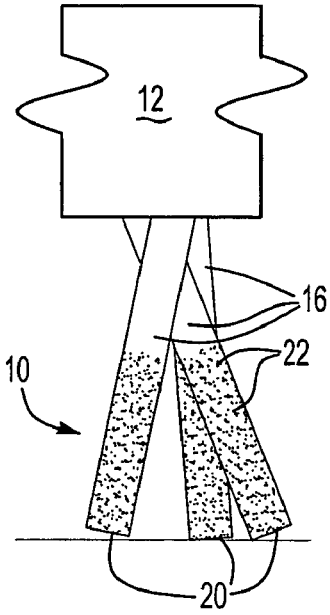
Fig-5
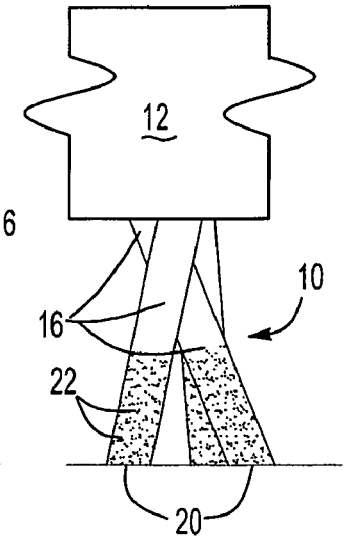
Fig-6
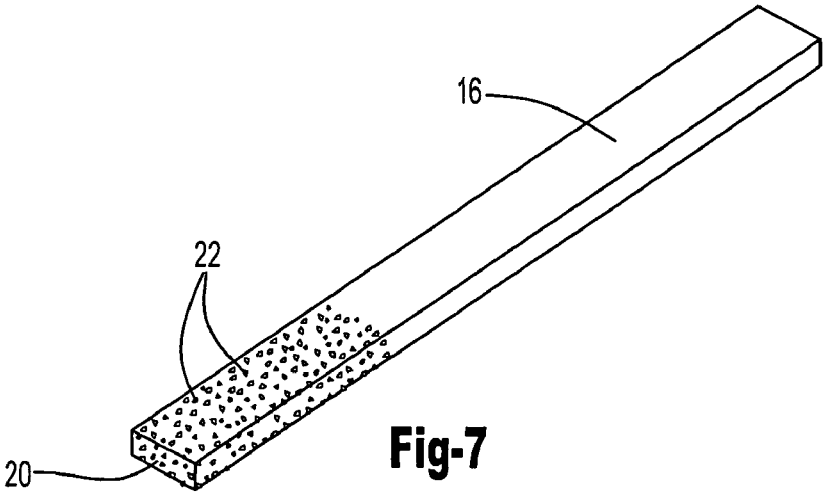
Fig-7

BRISTLE BRUSH FOR CONCRETE SANDING

This Application is a Continuation-In-Part of pending U.S. Ser. No. 10/851,393 filed on May 21, 2004.

TECHNICAL FIELD

The field of this invention relates to a reinforced brush for sanding concrete floors and surfaces.

BACKGROUND OF THE DISCLOSURE

While concrete or cement is a very popular material for use in floors and construction materials because of its strength, durability and low costs, if the concrete or cement is left unfinished, the concrete floor will inherently produce dust by the constant scuffing it undergoes whether by foot traffic or wheeled traffic and be susceptible to staining due to porosity.

One is thus faced with a dilemma of cleaning a concrete floor with its no gloss utilitarian appearance and with the disadvantage of the inevitable dust that emanates from an unfinished concrete floor or spending considerable money for a protective and decorative covering surface. Part of the expense to obtain a decorative and protective covering is due to the preparation of the concrete floor to accept a covering surface. The preparation often includes aggressive sanding to rough up the concrete surface and to remove any top surface or oil and grease stains to assure proper adhesion of the covering. Aggressive sanding of the concrete surface is a time consuming effort requiring frequent replacement of the sand paper as the sand particles become worn.

Attempts for more aggressive sanding and grinding pads have incorporated hardened particles such as diamonds or silicon carbide. While these pads performed well when new, the particle edges become rounded out through wear and the sanding performance substantially diminishes. Other problems are known that also prevent or limit the application of hardened particles. The present application of a bristle made from today's known higher temperature plastic materials when combined with the aforementioned hard abrasive materials generate much heat when used on a high speed power sander. The generated heat is sufficient to melt the plastic material and fuses the bristles together rendering the bristle pad useless. Previous metal bristles, if fully brazed with particles become too brittle and break off during high speed application.

Pads or wide sanding surfaces encounter problems with wavy or uneven concrete surfaces. They have a tendency to miss the low spots. As a result, to reach the low spots, they must remove the high spots which results in extra sanding and effort.

What is needed is a bristle brush for concrete sanding that has an improved performance profile by incorporating hardened particles along a substantial portion of its length which expose new particle edges as the bristle wears down. What is also needed is a more flexible metal bristle with hardened particles secured thereon with the brazed coating applied only where the diamonds are secured onto the bristle to maintain sufficient flexibility of the metal bristles. What is also needed is a flexible bristle that can prepare high and low spots of a concrete surface by better following the contour of the concrete surface.

SUMMARY OF INVENTION

In accordance with one aspect of the invention, a brush for a power sander for sanding concrete surfaces has a base for mounting onto a power sander and a plurality of bristles depending from the base. It is preferred that the bristles are mounted at varying angles with respect to the base. The bristles have a plurality of hard particles secured along a substantial length of a lower distal half of each bristle such that as the bristle wears down in use, new particle surfaces are exposed at a distal end of the bristles to maintain sanding performance of the brush.

Desirably, the bristles are made from a metal substrate. Preferably, the metal is a steel. The steel can preferably be stainless or carbon steel.

In one embodiment, the particles are diamond particles that are brazed onto the steel with a brazing alloy. The brazing alloy is positioned on the steel only where the diamond particles are brazed with areas of the steel free of brazing alloy interspersed between brazed areas to retain flexibility of the steel bristle.

In accordance with another aspect of the invention, a brush bristle for a power sander brush for sanding concrete has a wearable bristle substrate and a plurality of hard particles secured along a substantial length of the wearable bristle substrate such that as the bristle wears down during use, new particle surfaces are exposed at a distal end of the bristle to maintain sanding performance of the bristle.

In accordance with another aspect of the invention, a sanding brush for a power sander includes a base with a quick connect fitting for mounting to a power sander and a plurality of metal bristles mounted at different angles having respective distal ends all generally near the same horizontal plane. The plurality of bristles have diamond particles brazed thereon along a distal half. The bristles having a circular cross-sectional shape with a diameter being no greater than approximately ⅛ inch.

In accordance with another aspect of the invention, a bristle for power sanding has a metal substrate with hard abrasive particles brazed onto the metal substrate with a brazing material. The brazing material is positioned only where the particles are brazed onto the metal substrate with areas of the metal substrate free of brazing material being interspersed between the brazed areas to retain flexibility of the metal substrate.

BRIEF DESCRIPTION OF DRAWINGS

Reference now is made to the accompanying drawings in which:

FIG. 3 is an enlarged perspective view of one bristle shown in FIG. 1;

FIG. 4 is a cross-sectional view taken along lines 4—4 shown in FIG. 3;

FIG. 5 is an enlarged illustrative view of some bristles in operation when the brush is new;

FIG. 6 is a view similar to FIG. 5 illustrating use of the brush near the end of its useful life; and FIG. 7 is a perspective view of a modified bristle.

DETAILED DESCRIPTION OF THE PREFERRED EMBODIMENT

Figure 1:
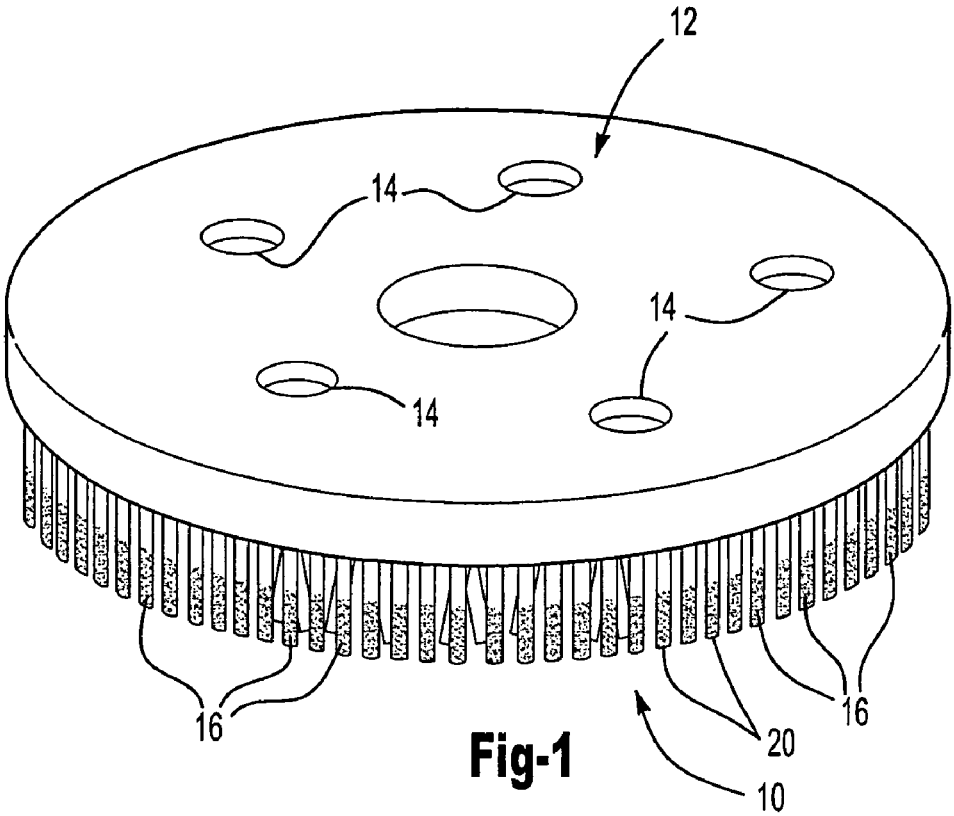
FIG. 1 is a perspective view of a bristle brush in accordance with one embodiment of the invention.
Figure 2:
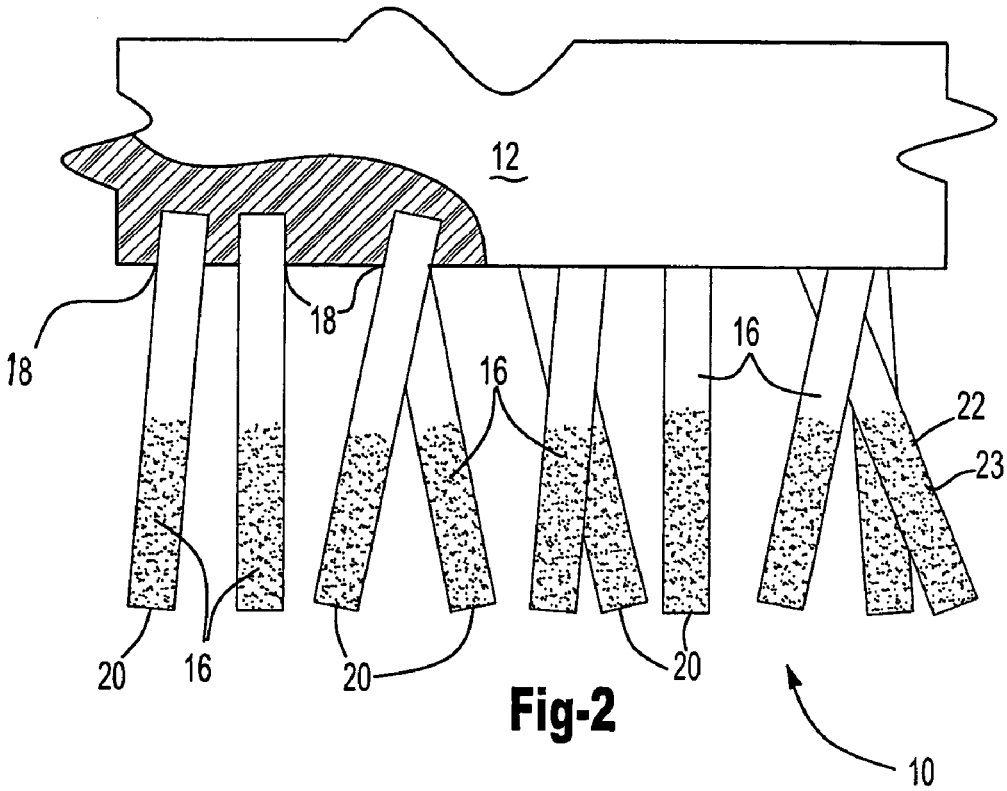
FIG. 2 is an enlarged fragmentary side view of the brush shown in FIG. 1.

Referring now to FIG. 1, an abrasive brush 10 for use on a conventional high speed power sanding machine (not shown), has a base 12 that has conventional quick connect fittings 14 in the form of apertures which removably snap fit onto conventional studs (not shown) on the sander. The base which can be made from a plastic material mounts a proximate end 18 of a plurality of bristles 16 extending from the base 12. The bristles 16 may be arranged in a generally vertical direction as shown in FIG. 1. Preferably as clearly shown in FIGS. 2, 5–6, the bristles extend downwardly at differing angles. Whatever the angle, each bristle preferably has its distal end 20 generally or nearly coplanar with the other distal ends as more clearly shown in FIG. 2.

Reference now is made to FIG. 3 and 4 where the bristle 16 is shown to have a plurality of diamond particles 22 brazed or otherwise secured onto the surface of the bristle from its distal end and extending at least halfway up the distal end, i.e. about one quarter of the length of each bristle. For manufacturing ease, the diamond particles may extend along the entire length of the each bristle. Depending on the specific application, gage of the bristle and flexibility desired for a specific sanding application, the diamond particles need to extend up to the wear point i.e. useful length of the bristle before the bristle brush is replaced.

The diamond grit may vary but it is foreseen that a grit of 70 is useful for many sanding applications for concrete floors. Other particulates may be substituted for the diamond particles, for example alumina silicate or silicon carbide. The bristle 16 preferably has a round cross section as shown in FIG. 4. The distal portion of the bristles has the brazed diamonds thereon. For example, if the bristle is 2 inches long, the distal one inch has the diamonds with no diamonds or braze above the midpoint. Other variations are foreseen such as a substantial portion of the distal half being covered by diamond particles or a substantial portion of the entire length of the bristle may have diamonds brazed thereon.

In one embodiment, the bristles may be made from stainless or carbon steel having a diameter of less than one millimeter up to one-eighth inch. The diamonds of 70 grit may be in a brazing alloy nickel slurry and sprayed onto the bristle with the brazing then being set with the diamonds secured in place. In this way, the bristle surface has the diamond particles 22 secured thereon with bristles areas 23 interspersed without diamonds or brazing materials. The presence of interspersed areas 23 retain flexibility of the steel bristle. If the entire bristle was saturated with brazing alloy, the bristles would become too brittle for the concrete sanding application.

Other ways are also foreseen, to provide areas 23 of different shapes. The particles can be spot brazed such as in stripes spots, or spirals to maintain interspersed areas 23 of steel bristle with no alloy thereon.

During use, the bristle 16 when new has its distal end 20 sand the concrete surface. It is found that the sharp edges of the diamond particles is sufficiently aggressive to sand the concrete surface and remove paint or other previously applied materials. The concrete floor quickly achieves a scratched surface in accordance with the grit sized used. The bristles do not clog with paint or smear any previously applied material such as paint or oil.

In contrast to plugs or other wide diamond impregnated prepping tools, the metal brush as it scours over the concrete with a power machine to force a pad pressure of 60–300 P.S.I. will gradually have its substrate wear away. When sufficient wear occurs to the bristle, the worn diamond particles 22 at the distal end will shed off the bristle to expose new sharp edges of other diamond particles 22 further up on the bristle. This wearing will continuously occur until sufficient amount of the bristle will wear away as shown in FIG. 6. Due to the introduction of new sharp edged diamond particles, the performance or aggressiveness of the bristles in FIG. 6 near the end of its useful life remains quite high relative to the performance of the bristles shown in FIG. 5 when the pad is new. The aggressiveness of the bristle pad remains high like a new pad. The needed flexibility of the bristles during sanding is retained by the flexible steel, metal or other substrate of the bristles. The flexible bristles allow the brush to reach low sections of an uneven floor without excessive removal from high sections.

While a round bristle is foreseen for most applications, a bristle with a generally rectangular i.e. flat contour can be used as shown in FIG. 7. Other modifications are possible, for example a roller with radially extending bristles for use with a drum sanding machine is also foreseen. It is also foreseen that high temperature plastics that can withstand the temperatures developed by a high speed power floor sander may be substituted for the metal substrate.

In this fashion, an aggressive abrader that can prepare concrete surfaces for application of a surface coating is provided that can abrade at multiple times faster than previous known plugs and sanding pads. The flexible bristles can follow the contour of a wavy or uneven floor surface to adequately prepare low sections or valleys of the concrete surface. The low section can be reached and sanded without extra removal from the high sections of the concrete surface. Hence, an uneven floor surface can be prepared for a coating more expeditiously and evenly.

Other variations and modifications are possible without departing from the scope and spirit of the present invention as defined by the appended claims.

The invention claimed is:

1. A brush for a power sander for sanding concrete surfaces; said brush comprising:

a base for mounting onto a power sander;

a plurality of bristles depending from said base; said bristles having a plurality of hard particles secured along a substantial length of a lower distal half of said bristle such that as said bristle wears down in use, new particle surfaces are exposed at distal end of said bristle to maintain sanding performance of the brush;

said bristles being made from steel, said particles being diamond particles being brazed onto said steel with a brazing alloy; and wherein a brazing alloy is positioned on said steel only where said diamond particles are brazed with areas of said steel free of brazing alloy interspersed between brazed areas to retain flexibility of said steel bristle.

2. A brush as defined in claim 1 further comprising:

said bristles being mounted at varying angles with respect to said base.

3. A brush for a power sander for sanding concrete surfaces; said brush comprising:

a base for mounting onto a power sander;

a plurality of bristles depending from said base; said bristles having a plurality of hard particles secured along a substantial length of a lower distal half of said bristle such that as said bristle wears down in use, new particle surfaces are exposed at a distal end of said bristle to maintain sanding performance of the brush;

said bristles being made from metal;

said particles being diamond particles being brazed onto said metal; and wherein a brazing alloy is positioned on said metal only where said diamond particles are brazed with areas of said metal free of brazing alloy interspersed between brazed areas to retain flexibility of said metal bristle.

4. A bristle for power sanding, said bristle comprising:

a metal substrate;

hard abrasive particles brazed onto said metal substrate with a brazing material; and said brazing material positioned only where said particles are brazed onto said metal substrate with areas of said metal substrate free of brazing material being interspersed between the brazed areas to retain flexibility of the metal substrate.

5. A bristle as defined in claim 4 further comprising:

said metal being steel; and said hard particles being diamonds.

* * * * *